US011649832B2

(12) United States Patent
Chang et al.

(10) Patent No.: US 11,649,832 B2
(45) **Date of Patent: *May 16, 2023**

(54) FAN IMPELLER

(71) Applicant: DELTA ELECTRONICS, INC., Taoyuan (TW)

(72) Inventors: Shun-Chen Chang, Taoyuan Hsien (TW); Chao-Fu Yang, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/741,933

(22) Filed: May 11, 2022

(65) Prior Publication Data

US 2022/0268296 A1 Aug. 25, 2022

Related U.S. Application Data

(62) Division of application No. 16/591,687, filed on Oct. 3, 2019, now Pat. No. 11,365,748.

(30) Foreign Application Priority Data

Nov. 28, 2018 (CN) ..... 201811433443.4

(51) Int. Cl.
*F04D 29/32* (2006.01)
*F04D 29/58* (2006.01)
*F04D 29/38* (2006.01)

(52) U.S. Cl.
CPC ..... *F04D 29/329* (2013.01); *F04D 29/388* (2013.01); *F04D 29/5853* (2013.01)

(58) Field of Classification Search
CPC .... F04D 29/329; F04D 29/181; F04D 29/322; F04D 29/34; F04D 29/382; F04D 29/384; F04D 29/386
See application file for complete search history.

(56) References Cited

U.S. PATENT DOCUMENTS 5,290,149 A 3/1994 Vieth
5,611,668 A 3/1997 Yapp et al.
(Continued)

FOREIGN PATENT DOCUMENTS

CN 1223027 A 7/1999
CN 101377208 A 3/2009
(Continued)

*Primary Examiner* — Woody A Lee, Jr.
*Assistant Examiner* — Brian O Peters
(74) *Attorney, Agent, or Firm* — Muncy, Geissler, Olds & Lowe, P.C.

(57) ABSTRACT

A fan impeller includes a hub, a shaft, a metal housing and a plurality of blades. The outer periphery of the hub has a curved surface. The shaft is disposed in the hub and connected to the hub. The metal housing has an annular shape and is disposed in the hub. A magnetic ring is disposed at the inner side of the metal housing. The blades are disposed around the outer periphery of the hub. The blades are projected along an extension direction toward the shaft to define projection areas thereof, and the projection area of a top and a bottom of any one of the blades is partially overlapped with other two adjacent blades. A distance between an outer edge of each blade and a rotational axis of the fan decreases proximate the top of the blade and then increases towards the bottom of the blade.

8 Claims, 9 Drawing Sheets

(56) References Cited

U.S. PATENT DOCUMENTS

| | | | |
|---|---|---|---|
| 5,695,318 | A | 12/1997 | Harmsen |
| 5,814,908 | A | 9/1998 | Muszynski |
| 6,386,830 | B1 | 5/2002 | Slipper et al. |
| 6,860,713 | B2 | 3/2005 | Hoover |
| 7,137,706 | B2 | 11/2006 | Kawahara et al. |
| 7,380,955 | B2 | 6/2008 | Lu et al. |
| 7,584,780 | B1 | 9/2009 | Lemont et al. |
| 10,864,683 | B2 | 12/2020 | Tsurugai et al. |
| 2002/0094271 | A1 | 7/2002 | Yeuan et al. |
| 2004/0126232 | A1 | 7/2004 | Lin et al. |
| 2005/0254957 | A1 | 11/2005 | Li et al. |
| 2007/0013242 | A1 | 1/2007 | Tung et al. |
| 2008/0219837 | A1 | 9/2008 | Chang et al. |
| 2008/0240921 | A1 | 10/2008 | Chang et al. |
| 2009/0226312 | A1 | 9/2009 | Liu et al. |
| 2014/0356054 | A1 | 12/2014 | Chang et al. |
| 2014/0356149 | A1 | 12/2014 | Chang et al. |
| 2019/0390680 | A1 | 12/2019 | Chang et al. |

FOREIGN PATENT DOCUMENTS

| | | | |
|---|---|---|---|
| CN | 1896550 | A | 1/2017 |
| DE | 102005007810 | A1 | 4/2006 |
| WO | WO-2017047786 | A1 | 3/2017 |

FAN IMPELLER

CROSS REFERENCE TO RELATED APPLICATIONS

This Non-provisional application is a Divisional Application (DA) of an earlier filed, pending application, having application Ser. No. 16/591,687 and filed on Oct. 3, 2019, which claims priority under 35 U.S.C. § 119(a) on Patent Application No(s). 201811433443.4 filed in People's Republic of China on Nov. 28, 2018, the entire contents of which are hereby incorporated by reference.

BACKGROUND OF THE DISCLOSURE

Field of Disclosure

The present disclosure relates to a fan impeller and, in particular, to a fan impeller that has a low manufacturing cost and a strengthened structure and can maintain the operation performance.

Related Art

As the performance of electronic devices continuously increases, the current electronic devices generate a large amount of waste heat during operation. If the heat cannot be immediately removed from the electronic device, the temperature of the electronic device will rise, thereby causing damage to internal components and reducing the performance and lifetime of the electronic device. Fans are the heat-dissipation devices that are widely used in electronic devices. At present, those skilled in the art have developed a mixed flow fan with the blades and hub having two or more unequal diameters. However, the top surface of the blade of the conventional mixed flow fan is usually a large planar surface, and the rotating elements (e.g. the housing, magnetic tape and shaft) are disposed therein. Herein, the top surface of the housing is also a planar surface. Although the structure of non-planar top surface has been developed, it is needed to use much plastic material on the housing during the molding process, thereby increasing the manufacturing cost and decreasing the available space thereof. In addition, in the conventional mixed flow fan, no enhancement element is provided at the shaft, so the entire structure of the mixed flow fan is not stable, which can affect the performance and safety of the fan.

Therefore, it is desired to provide a fan impeller that has a low manufacturing cost and a strengthened structure and can maintain the operation performance.

SUMMARY OF THE DISCLOSURE

An objective of this disclosure is to provide a fan impeller of a mixed flow fan. Compared with the conventional fan impeller, the fan impeller of this disclosure has a low manufacturing cost and a strengthened structure and can maintain the operation performance.

The present disclosure provides a fan impeller, comprising a hub, a shaft, a metal housing, and a plurality of blades. The outer periphery of the hub has a curved surface, and the slopes of straight lines connecting any two points on the curved surface are not equal. The shaft is disposed in the hub and connected to the hub. The metal housing has an annular shape and is disposed in the hub. The blades are disposed around the outer periphery of the hub.

In one embodiment, the hub and the blades are projected along an extension direction toward the shaft to define projection areas thereof, and the projection area of each of the blades is partially overlapped with the projection area of the hub.

In one embodiment, the hub defines a top portion and a bottom portion, so that the top portion is located at a center of the projection area of the hub, and the bottom portion is located an edge of that of the hub.

In one embodiment, an annular extension portion is formed in the hub, the extension portion extends from an inner side of the hub to an axis of the shaft, and the metal housing is connected with the hub by the extension portion.

In one embodiment, a plurality of spacers are disposed between the bottom portion of the hub and the extension portion, and any adjacent two of the spacers form an accommodating space therebetween.

In one embodiment, the fan impeller further comprises at least a rib disposed inside the hub, and the rib covers the shaft.

In one embodiment, the fan impeller further comprises a magnetic ring or an annular magnet disposed inside the metal housing.

In one embodiment, the metal housing extends toward the extension portion of the hub, and the metal housing protrudes beyond the extension portion or aligns with the extension portion.

The present disclosure also provides a fan impeller comprising a hub, a shaft, a metal housing and a plurality of blades. The outer periphery of the hub has a curved surface, and slopes of straight lines connecting any two points on the curved surface are not equal. The shaft is disposed in the hub. The metal housing is disposed in the hub and has a top surface, and the shaft is connected with the top surface. The blades are disposed around the outer periphery of the hub.

In one embodiment, the top surface of the metal housing is formed with at least a through hole, and when the hub is formed by injection molding, a heat stake is formed in the through hole for connecting the hub and the metal housing.

In one embodiment, the shaft is connected with the metal housing by welding.

In one embodiment, the top surface of the metal housing is formed with a heat-dissipation hole.

In one embodiment, the hub and the blades are projected along an extension direction toward the shaft to define projection areas thereof, and the projection area of each of the blades is partially overlapped with that of the hub.

In one embodiment, the hub defines a top portion and a bottom portion, the top portion is located at a center of that of the hub, and the bottom portion is located an edge of that of the hub.

In one embodiment, an annular extension portion is formed in the hub, the extension portion extends from an inner side of the hub to an axis of the shaft, and the metal housing is connected with the hub by the extension portion.

In one embodiment, the fan impeller further comprises a magnetic ring disposed inside the metal housing.

In one embodiment, the metal housing extends toward the extension portion of the hub, and the metal housing protrudes beyond the extension portion or aligns with the extension portion.

As mentioned above, the fan impeller of this disclosure can be manufactured with less plastic material, the internal space of the hub can be effectively utilized, the structure can be strengthened, and the operation performance can be maintained.

BRIEF DESCRIPTION OF THE DRAWINGS

The present disclosure will become more fully understood from the subsequent detailed description and accompanying drawings, which are given by way of illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

Figure 1:
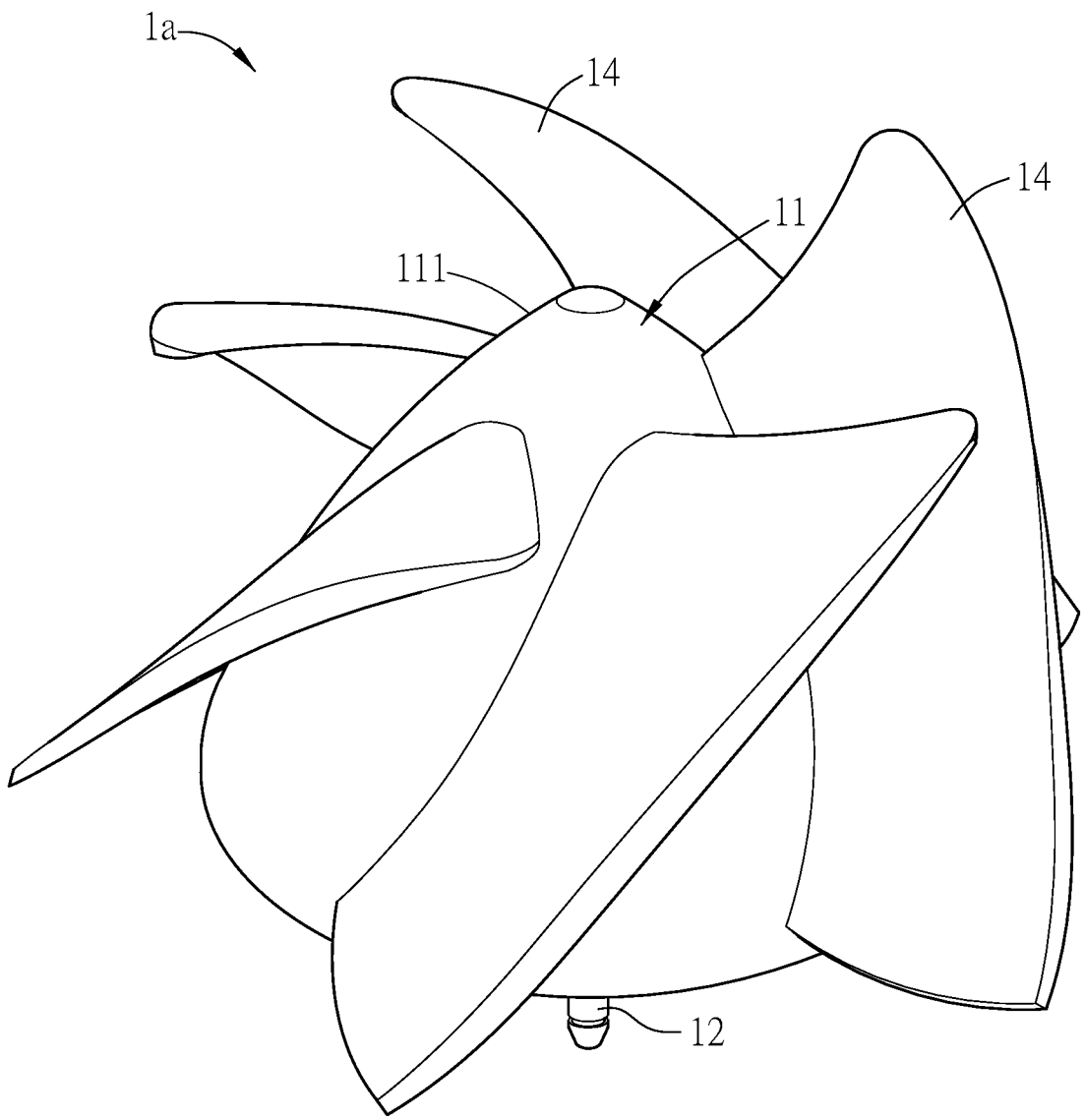
FIG. 1 is a schematic diagram showing the fan impeller according to a first embodiment of this disclosure.
Figure 2:
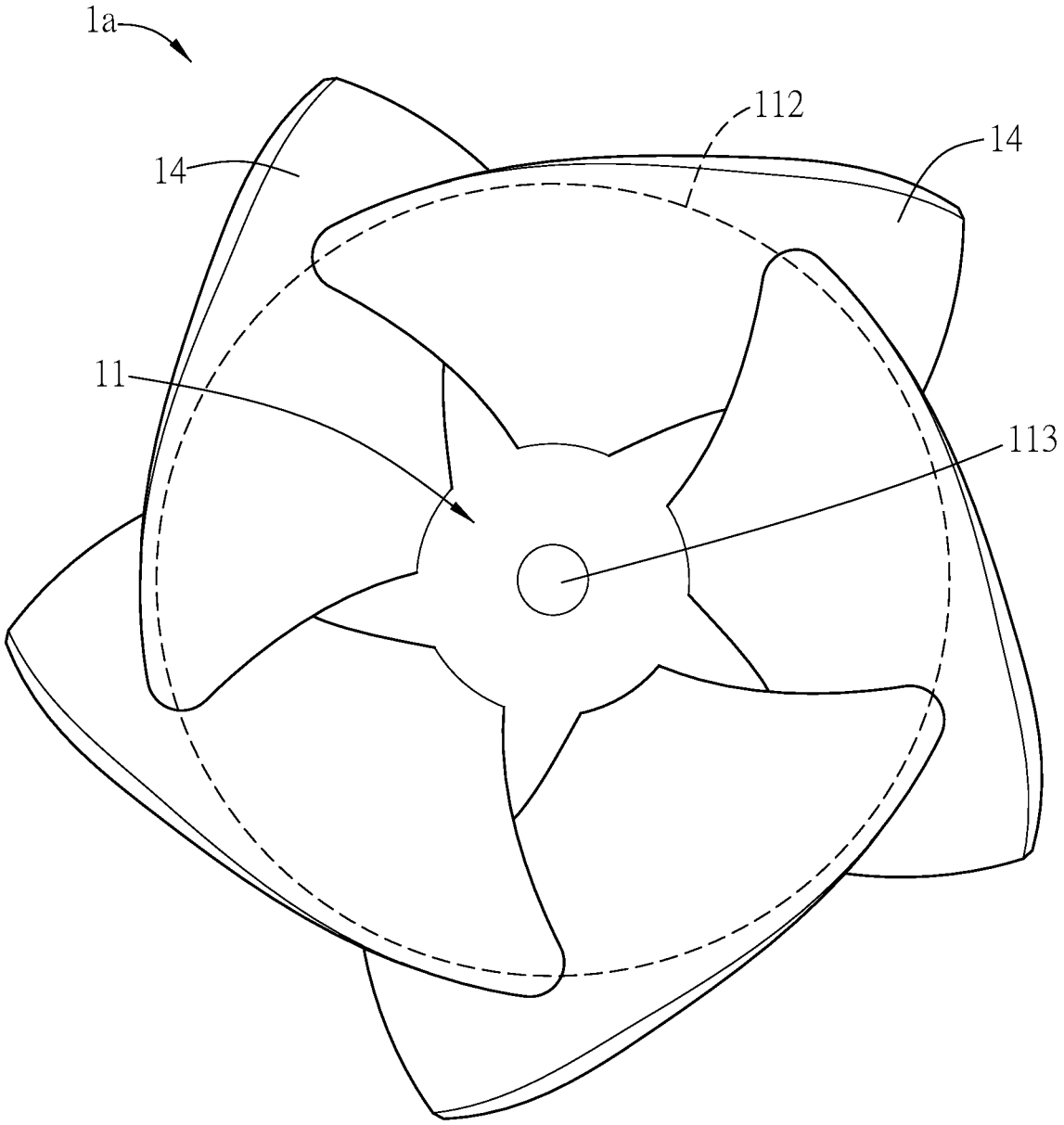
FIG. 2 is a top view of the fan impeller according to the first embodiment of this disclosure.

FIGS. 1 and 2 are a schematic diagram and a top view of a fan impeller according to a first embodiment of this disclosure. As shown in FIGS. 1 and 2 the fan impeller 1*a* comprises a hub 11, a shaft 12, and a plurality of blades 14 disposed around the hub 11. The hub 11 has a curved surface 111, and the blades 14 substantially extend outwardly from the curved surface 111. Referring to FIG. 2, the hub 11 forms a projection area. The center of the projection area is a top portion 113 of the hub 11, and the edge of the projection area is a bottom portion 112 of the hub 12. The blades 14 also form corresponding projection areas. The projection areas of the blades 14 are partially overlapped with that of the hub 11.

Figure 3:
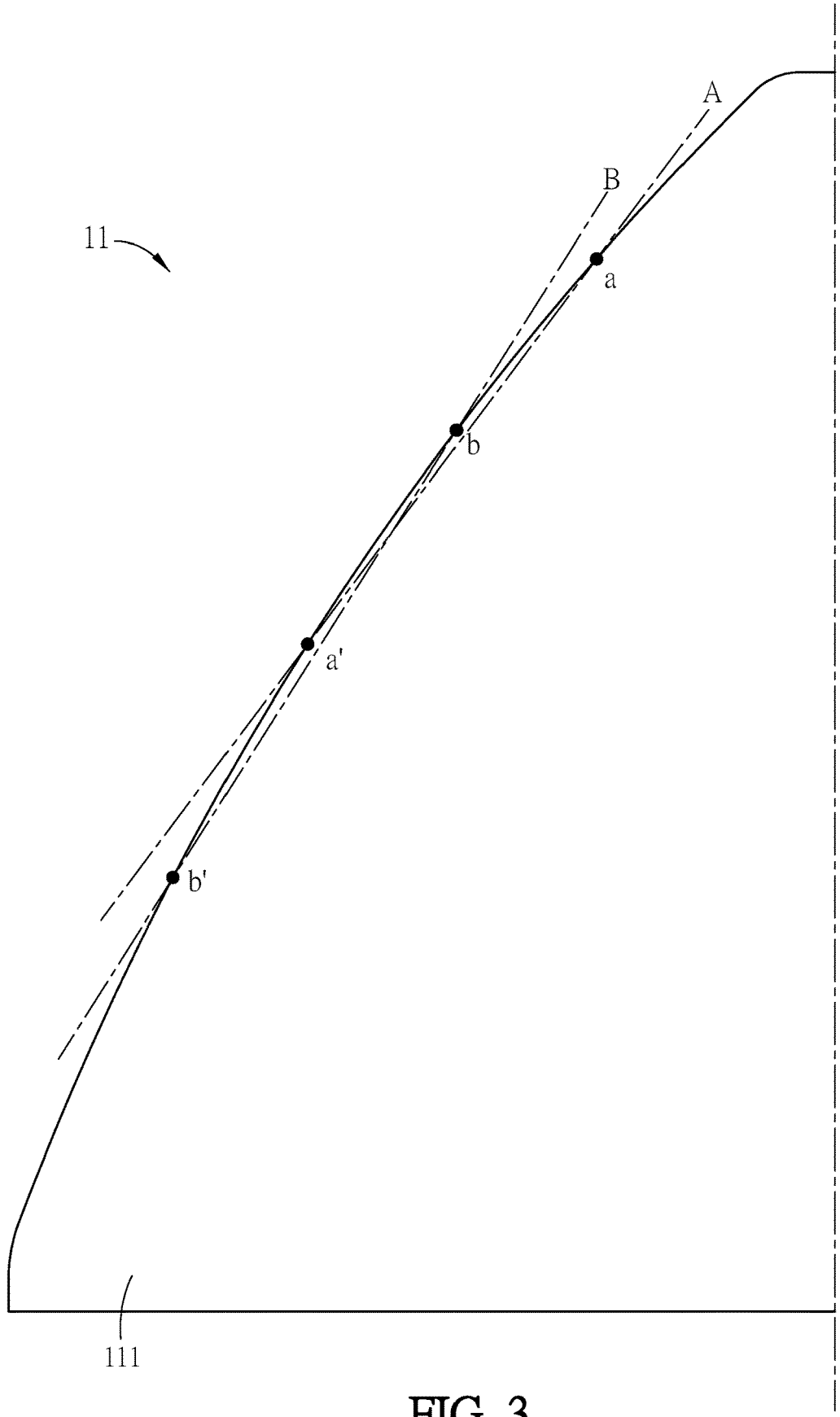
FIG. 3 is a schematic diagram showing the outer periphery of the hub of the fan impeller according to the first embodiment of this disclosure.

FIG. 3 is a schematic diagram showing the outer periphery of the hub 11 of the fan impeller 1*a* according to the first embodiment of this disclosure. The feature of the curved surface 111 on the outer periphery of the hub 11 of the fan impeller 1*a* will be described hereinafter with reference to FIG. 3. To be noted, FIG. 3 only shows the curved surface 11 of the outer periphery of the hub 11. As shown in FIG. 3, a straight line A connects two points a and a' on the curved surface 111, and a straight line B connects two points b and b' on the curved surface 111. In this embodiment, the slope of the straight line A and the slope of the straight line B are unequal to each other. That is, the slopes of straight lines connecting any two points on the curved surface 111 are not equal. In all fan impellers of this disclosure, the curved surfaces of the hubs all have the above-mentioned feature.

Figure 4:
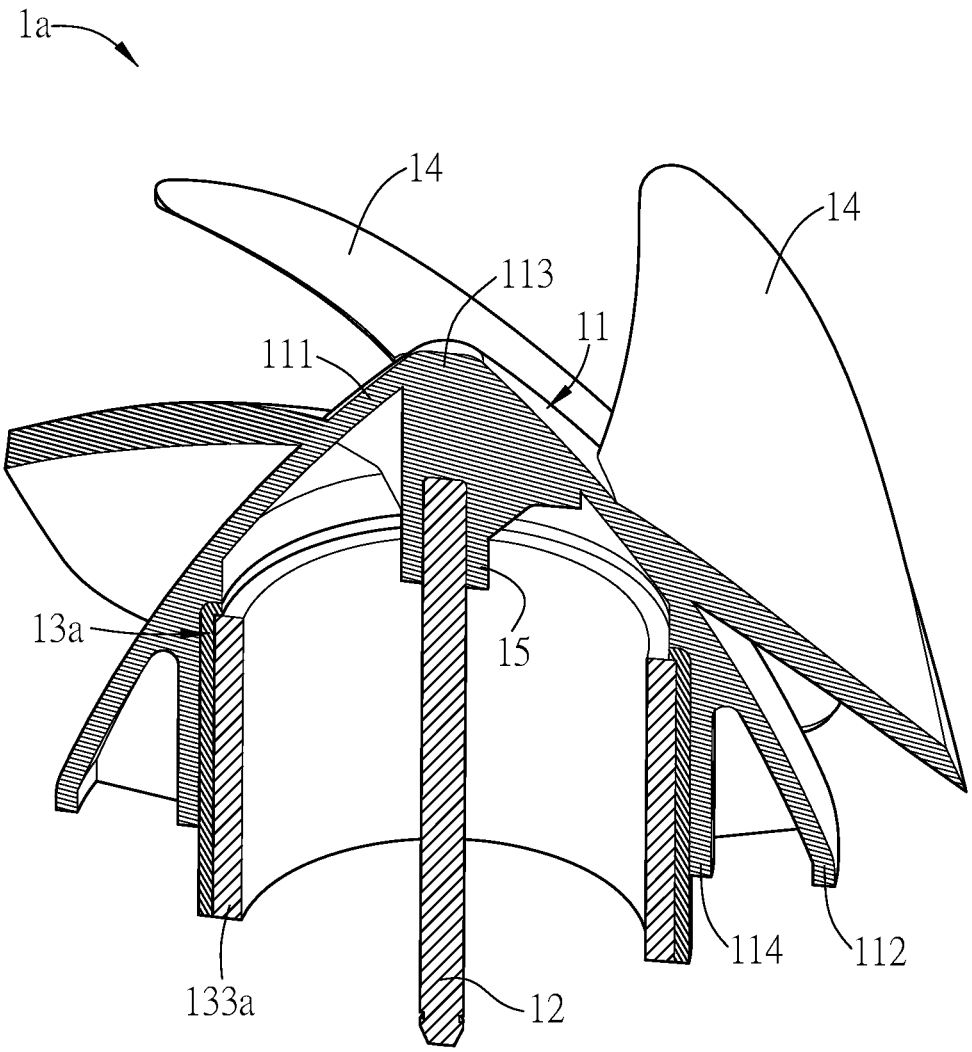
FIG. 4 is a sectional view of the fan impeller according to the first embodiment of this disclosure.

FIG. 4 is a sectional view of the fan impeller 1*a* according to the first embodiment of this disclosure. As shown in FIG. 4, the fan impeller 1*a* comprises a hub 11, a shaft 12, a metal housing 13*a*, and a plurality of blades 14. The shaft 12 is disposed in the hub 11 and connected to the hub 11. The metal housing 13*a* has an annular shape and is disposed in the hub 11. The blades 14 are disposed around the outer periphery of the hub 11.

The fan impeller 1*a* of this embodiment further comprises at least one rib 15 disposed in the hub 11. The at least one rib 15 covers the shaft 12 for enhancing the connection strength between the shaft 12 and the hub 11.

In this embodiment, a space is formed in the hub 11, and the shaft 12 is disposed in the hub 11 and connected to the hub 11. The metal housing 13*a* has an annular shape and is disposed in the space of the hub 11. As shown in the figure, an annular extension portion 114 is formed in the hub 11. The extension portion 114 extends from the space of the hub 11 to an axis of the shaft 12, and the metal housing 13*a* is connected with the hub 11 by the extension portion 114.

In this embodiment, the metal housing 13*a* can be made of, for example, a magnetic material containing iron.

The fan impeller 1*a* of this embodiment further comprises a magnetic ring 133*a* disposed inside the metal housing 13*a*. The material of the magnetic ring 133*a* can be a magnetic rubber or a magnet.

In this embodiment, the metal housing 13*a* extends toward the extension portion 114, and the metal housing 13*a* protrudes beyond the extension portion 114, so that the magnetic ring 133*a* inside the metal housing 13 can protrude beyond the bottom portion 112 of the hub 11. Accordingly, the magnetic ring 133*a* can have a larger size for increasing the magnetic force.

Figure 5:
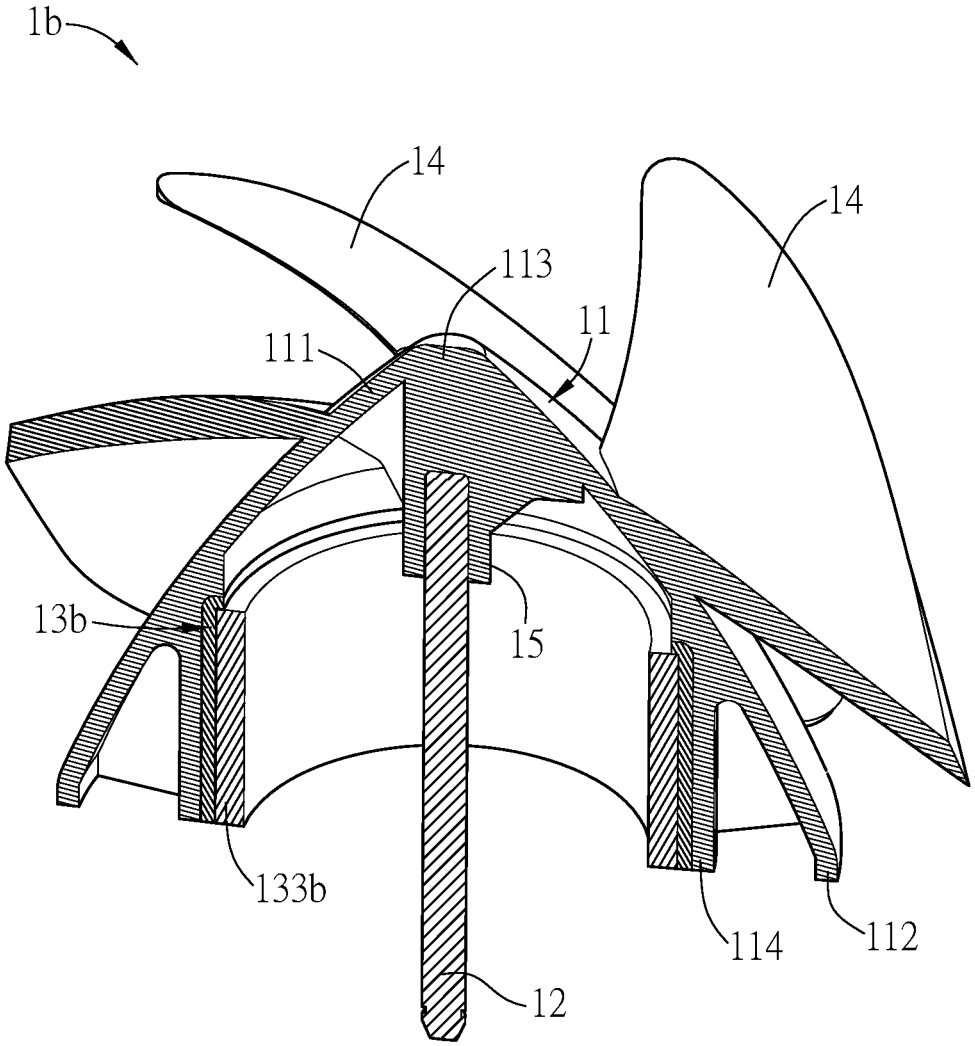
FIG. 5 is a sectional view of the fan impeller according to a second embodiment of this disclosure.

FIG. 5 is a sectional view of a fan impeller 1*b* according to a second embodiment of this disclosure. The structure of the fan impeller 1*b* as shown in FIG. 5 is mostly the same as that shown in FIG. 4. Different from the embodiment of FIG. 4, as shown in FIG. 5, the metal housing 13*b* and the magnetic ring 133*b* are aligned with the extension portion 114.

Figure 6:
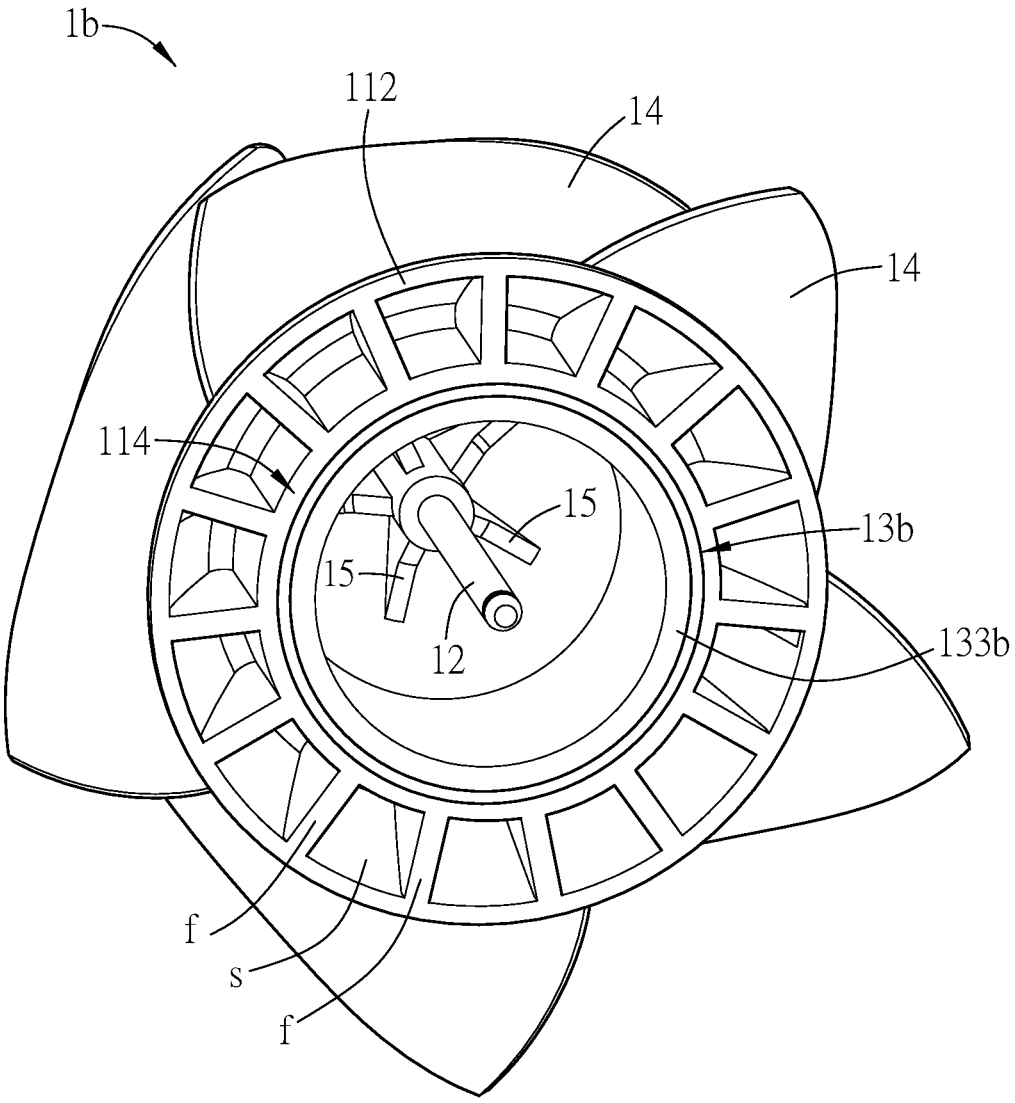
FIG. 6 is a bottom view of the fan impeller according to the second embodiment of this disclosure.

FIG. 6 is a bottom view of the fan impeller 1*b* according to the second embodiment of this disclosure. Referring to FIGS. 5 and 6, in the fan impeller 1*b* of this embodiment, a plurality of spacers f are formed between the bottom portion 112 and the extension portion 114 of the hub 11, and any two adjacent spacers f form an accommodating space s therebetween. In general, the fan impeller 1*b* of this embodiment is usually applied to the high speed fan, which has the rotation speed of 10,000 RPM or higher. The accommodating space s can be used to fill the balance material (e.g. clay) for calibrating the weight balance of the fan impeller 1*b*. This configuration can increase the stability in high speed rotation. In addition, the configuration of the accommodating space s can be also realized as removing a part material of the hub 11, which can decrease the total weight of the fan impeller 1*b*. In other words, the accommodating spaces s between the spacers f are not filled with the material of the hub 11, so that the total amount of material can be reduced, thereby saving the manufacturing cost of the hub 11.

As shown in FIG. 6, a plurality of ribs 15 can be formed at the connection of the hub 11 and the shaft 12 for enhancing the structural stability. The numbers of the ribs 15 can be adjusted according the actual requirement of the user, and this disclosure is not limited. The space between two adjacent ribs 15 can also be filled with the balance material (e.g. clay) for calibrating the weight balance of the fan impeller 1*b*.

The spacers f and the accommodating spaces s of the fan impeller 1*b* of the second embodiment as shown in FIG. 6 are for illustrations only. Of course, the fan impeller 1*a* of the first embodiment can also be configured with the spacers f and the accommodating spaces s.

Figure 7A:
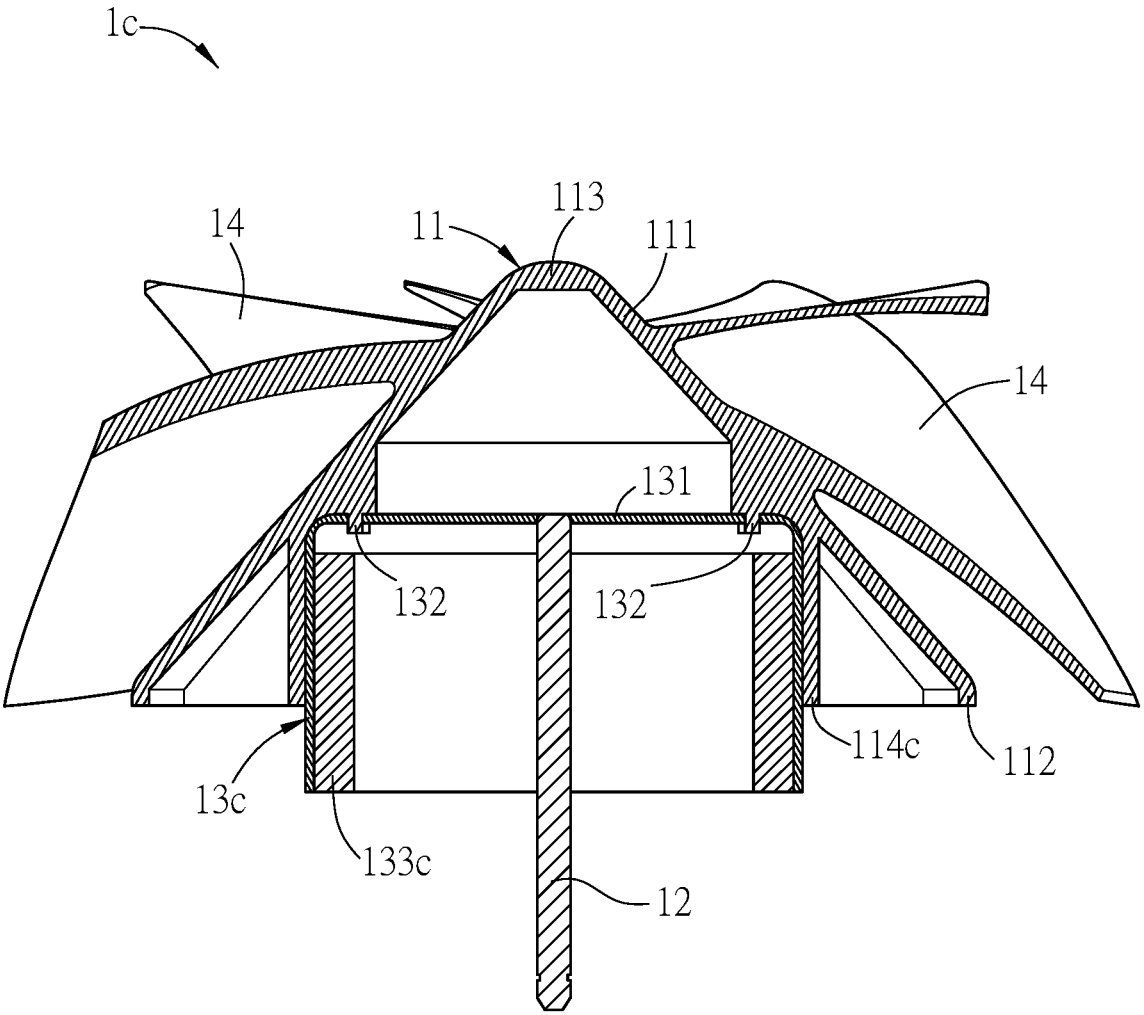
FIG. 7A is a sectional side view of the fan impeller according to a third embodiment of this disclosure.
Figure 7B:
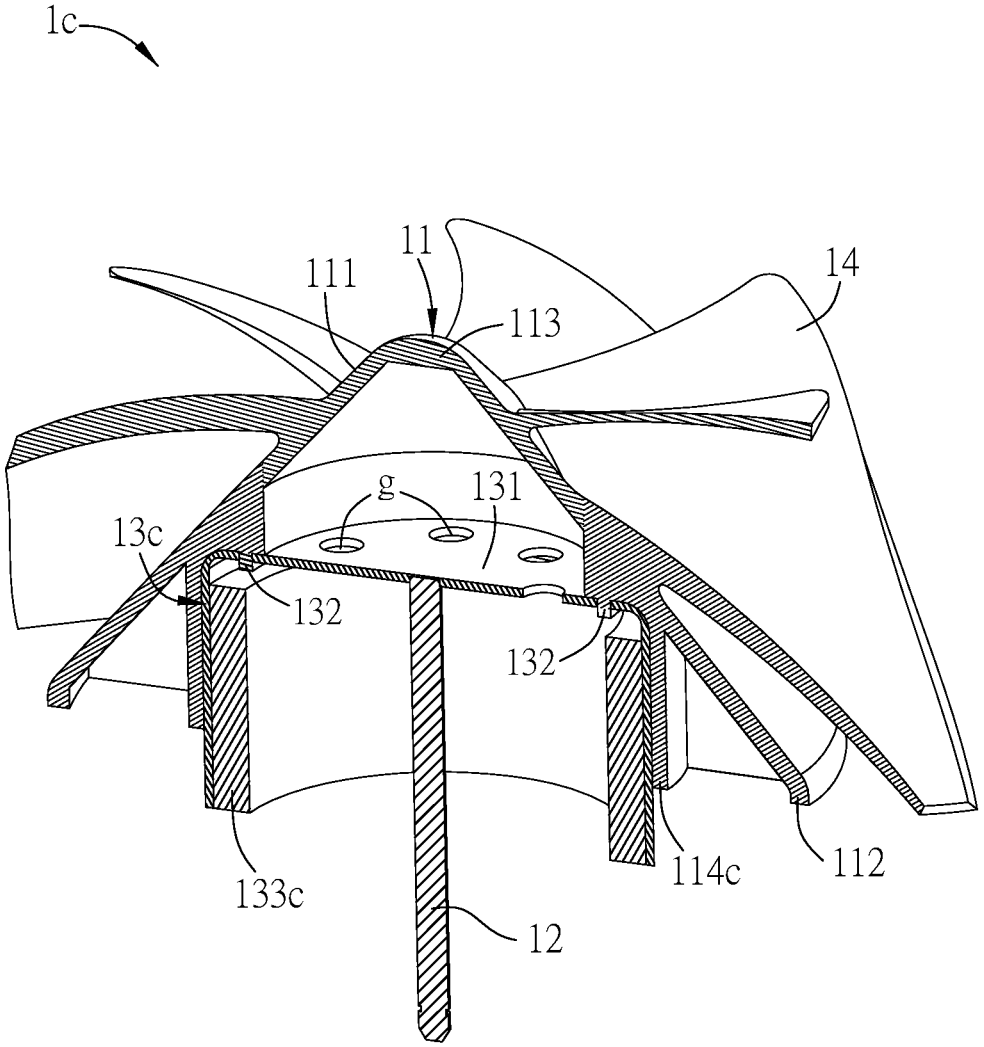
FIG. 7B is a sectional view of the fan impeller according to the third embodiment of this disclosure.

FIG. 7A is a sectional side view of a fan impeller 1*c* according to a third embodiment of this disclosure, and FIG. 7B is a sectional view of the fan impeller 1*c* according to the third embodiment of this disclosure. In this embodiment, the fan impeller 1*c* comprises a hub 11, a shaft 12, a metal housing 13*c*, and a plurality of blades 14. The outer periphery of the hub 11 has a curved surface, and the slopes of straight lines connecting any two points on the curved surface 111 are not equal. The shaft 12 is disposed in the hub 11. The metal housing 13*c* is disposed in the hub 11 and has a top surface 131, and the shaft 12 is connected with the top surface 131. The blades 14 are disposed around the outer periphery of the hub 11.

In this embodiment, the metal housing 13*c* is disposed in the hub 11, and the top surface 131 of the metal housing 13*c* is connected with the shaft 12. Accordingly, when the shaft 12 rotates, the hub 11 can be driven by the shaft 12 to rotate. The shaft 12 can be connected with the metal housing 13*c* by, for example but not limited to, welding (e.g. laser welding).

In this embodiment, the top surface 131 of the metal housing 13*c* is formed with at least one through hole 132. When the hub 11 is formed by injection molding, a heat stake can be formed in the through hole 132 for connecting the hub 11 and the metal housing 13*c*. The numbers of the through holes 132 can be adjusted based on the actual requirement of the user, and this disclosure is not limited thereto.

In this embodiment, the top surface 131 of the metal housing 13*c* can be formed with a plurality of heat-dissipation holes g. After the fan impeller 1*c* connects with the motor, the configured heat-dissipation holes g can help to dissipate the internal heat of the fan impeller 1*c* during high-speed rotation.

In this embodiment, the metal housing 13*c* can be formed by punching, and the material of the metal housing 13*c* is iron. In this embodiment, a magnetic ring 133*c* can be provided on the inner side of the metal housing 13*c*. The material of the magnetic ring 133*c* can be a magnetic rubber or a magnet.

In this embodiment, the hub 11 and the blades 14 are projected along an extension direction toward the shaft 12 to define projection areas thereof, and the projection area of each of the blades 14 is partially overlapped with the projection area of the hub 11.

In this embodiment, an annular extension portion 114*c* is formed in the hub 11. The extension portion 114*c* extends from an inner space of the hub 11 to an axis of the shaft 12. The metal housing 13*c* is connected with the hub 11 by the extension portion 114*c*. The metal housing 13*c* protrudes beyond the extension portion 114*c*, so that the magnetic ring 133*c* inside the metal housing 13*c* can protrude beyond the bottom portion 112 of the hub 11. Accordingly, the magnetic ring 133*c* can have a larger size for increasing the magnetic force.

Figure 8:
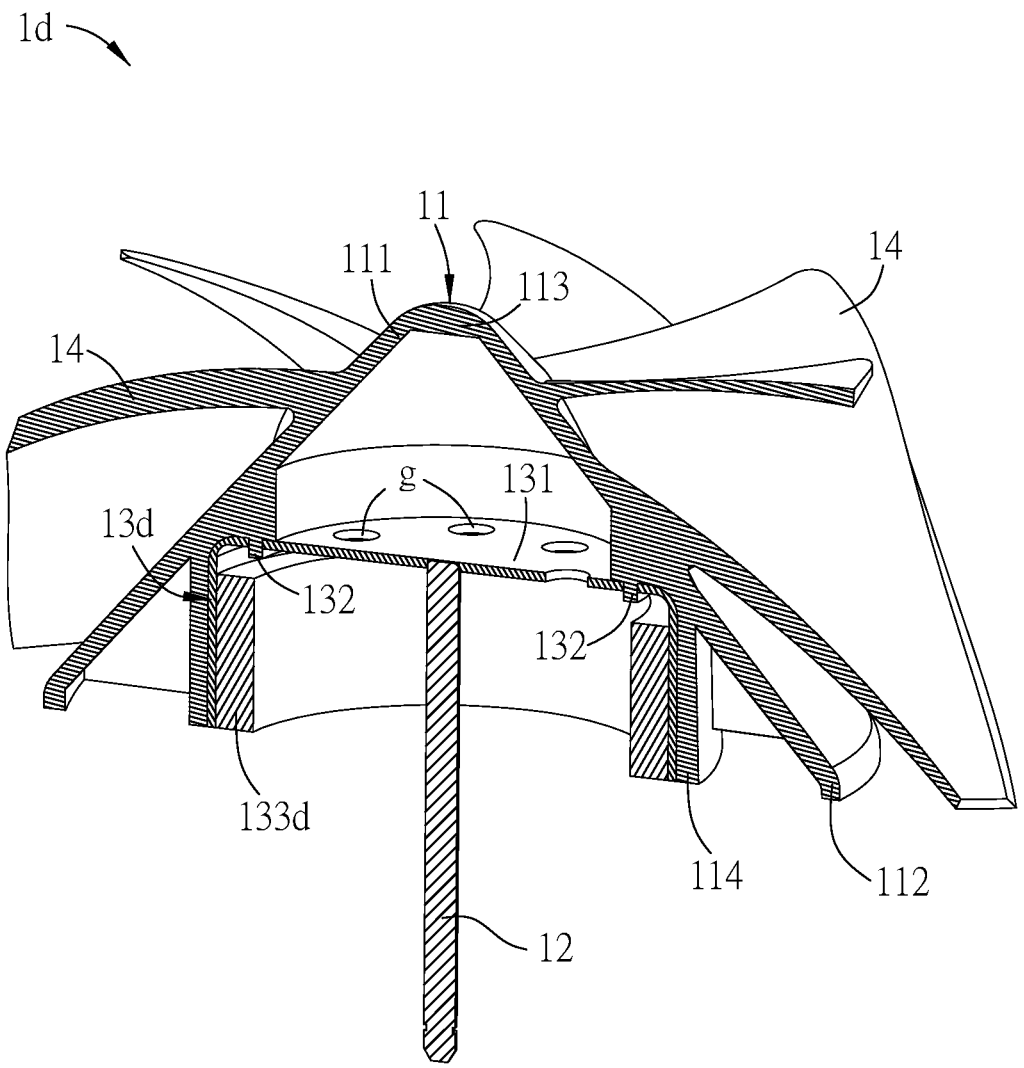
FIG. 8 is a sectional view of the fan impeller according to a fourth embodiment of this disclosure.

FIG. 8 is a sectional view of a fan impeller 1*d* according to a fourth embodiment of this disclosure. The features of the fan impeller 1*d* as shown in FIG. 8 are mostly the same as those of the third embodiment. Different from the third embodiment, as shown in FIG. 8, the metal housing 13*d* and the magnetic ring 133*d* are aligned with the extension portion 114.

Although the present disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present disclosure.

What is claimed is:

1. A fan impeller, comprising:

a hub, wherein an outer periphery of the hub has a curved surface, a top portion of the hub has a curved surface, and slopes of straight lines connecting any two points on the curved surfaces are not equal;

a shaft disposed in the hub and connected to the hub;

a metal housing having an annular shape and disposed in the hub; and a plurality of blades disposed around the outer periphery of the hub;

wherein the blades are projected along an extension direction toward the shaft to define projection areas thereof, and the projection area of a top and a bottom of any one of the blades is partially overlapped with other two adjacent blades, a distance between an outer edge of each blade and a rotational axis of the fan decreases proximate the top of the blade and then increases towards the bottom of the blade.

2. The fan impeller according to claim 1, wherein the hub and the blades are projected along the extension direction toward the shaft to define projection areas thereof, and the projection area of each of the blades is partially overlapped with that of the hub.

3. The fan impeller according to claim 2, wherein the hub defines the top portion and a bottom portion, the top portion is located at a center of the projection area of the hub, and the bottom portion is located an edge of that of the hub.

4. The fan impeller according to claim 3, wherein an annular extension portion is formed in the hub, the extension portion extends from an inner side of the hub to an axis of the shaft, and the metal housing is connected with the hub by the extension portion.

5. The fan impeller according to claim 4, wherein a plurality of spacers are disposed between the bottom portion of the hub and the extension portion, and any adjacent two of the spacers form an accommodating space therebetween.

6. The fan impeller according to claim 4, wherein the metal housing extends toward the extension portion of the hub, and the metal housing protrudes beyond the extension portion or aligns with the extension portion.

7. The fan impeller according to claim 1, further comprising at least a rib disposed inside the hub, wherein the rib covers the shaft.

8. The fan impeller according to claim 1, further comprising a magnetic ring or an annular magnet disposed inside the metal housing.

* * * * *